US007806807B2

(12) United States Patent
Genua

(10) Patent No.: US 7,806,807 B2
(45) Date of Patent: Oct. 5, 2010

(54) EXERCISE DEVICE FOR IMPROVING BALANCE

(76) Inventor: Paul Genua, 139 Trothen Circle, Markham, Ontario (CA) L3P 4H4

( * ) Notice: Subject to any disclaimer, the term of this patent is extended or adjusted under 35 U.S.C. 154(b) by 0 days.

(21) Appl. No.: 11/591,821

(22) Filed: Nov. 2, 2006

(65) Prior Publication Data

US 2007/0117697 A1 May 24, 2007

(30) Foreign Application Priority Data

Nov. 8, 2005 (CA) ..... 2526282

(51) Int. Cl.
*A63B 22/00* (2006.01)
*A63B 71/00* (2006.01)
*A63B 23/08* (2006.01)
*A63B 22/16* (2006.01)

(52) U.S. Cl. ..... 482/51; 482/79; 482/146

(58) Field of Classification Search ..... 482/123, 482/142, 908, 79, 77, 51, 34, 80, 110, 131, 482/146, 148; 273/440, 449; 434/258, 449, 434/253; D21/671, 688, 689, 769
See application file for complete search history.

(56) References Cited

U.S. PATENT DOCUMENTS 3,024,021 A 3/1962 Coplin et al.
4,538,476 A * 9/1985 Luque ..... 74/471 XY
4,739,986 A * 4/1988 Kucharik et al. ..... 482/79
5,518,476 A * 5/1996 McLeon ..... 482/79
5,613,690 A * 3/1997 McShane et al. ..... 273/449
5,795,277 A 8/1998 Bruntmyer
5,897,464 A * 4/1999 Mcleod ..... 482/79
6,225,977 B1 * 5/2001 Li ..... 345/156
6,543,769 B1 * 4/2003 Podoloff et al. ..... 273/148 B
6,723,030 B1 * 4/2004 Chen ..... 482/146
7,300,392 B1 * 11/2007 Curran ..... 482/146
2003/0045410 A1 * 3/2003 Kao ..... 482/148
2004/0097343 A1 * 5/2004 Chen ..... 482/79
2005/0164836 A1 * 7/2005 Harker et al. ..... 482/52
2007/0027009 A1 * 2/2007 Arnold ..... 482/146

OTHER PUBLICATIONS

Balance Trainer for Better Core Stability, Agility and Mobility, 1985-2007 Fitter International Inc., http://www.fitter1.com/balance.html?mtcPromotion=home-nav%3Ebalance-boards.

* cited by examiner

*Primary Examiner*—Loan Thanh
*Assistant Examiner*—Sundhara M Ganesan
(74) *Attorney, Agent, or Firm*—The Webb Law Firm

(57) ABSTRACT

An exercise device for improving balance, comprising a platform; a balancing element mounted to the platform so as to permit angular displacement of the balancing element relative to the platform; an adjustable angular displacement limiter for determining a limit of the angular displacement of the balancing element relative to the platform; and an adjustment access path to provide adjustment access to the limiter while the balancing element is operably mounted to the platform.

20 Claims, 7 Drawing Sheets

EXERCISE DEVICE FOR IMPROVING BALANCE

FIELD OF THE INVENTION

This invention relates to the fields of physical fitness and medical rehabilitation. In particular, this invention relates to the fields of devices for improving physical fitness, and for medical rehabilitation.

BACKGROUND OF THE INVENTION

In cases where a patient has had ankle, knee, or hip surgery, it is sometimes necessary for a patient to gradually strengthen muscles, tendons, or ligaments associated with or located near those joints. Such muscles, tendons, or ligaments are often associated with maintaining balance, and they can often be strengthened by the use of a device that requires a user to balance himself.

In addition, there are various sporting activities and athletic endeavours that require balance, and a person may wish to improve his balance in order to improve his performance in such sporting activities and athletic endeavours. In such a case, a user may wish to train using a balancing device.

There are different types of balancing devices available. One is a "rocker", consisting of a platform and an elongate balancing element. The user attempts to balance himself about the axis of the balancing element, and in doing so, usually produces a "rocking" motion.

Another example is early multi-directional balancing devices (often referred to as "wobblers") that comprised a platform having an underside to which a semi-spherical balancing element is attached. The balancing element would be placed on the floor, and the user would stand on the opposite side of the platform, attempting to balance on the balancing element without allowing the platform to touch the ground, thus producing a "wobbling" motion. Such a device is shown in U.S. Pat. No. 3,024,021.

In a variant of such a design, the balancing element is supported against the bottom of the platform with springs, or other flexible elements. This is shown in FIG. 5 of U.S. Pat. No. 3,024,021. This can add an additional element of balancing for the user, because the user must not only balance his body about the balancing element to keep the platform from touching the ground; in addition, the balancing element itself is capable of angular displacement relative to the platform, and the user must keep his balance despite the angular displacement.

For both medical rehabilitation and physical fitness applications, it is desirable to gradually increase the difficulty of the balancing exercise, as the user's balance improves. Thus, in the wobbler sold by Fitterfirst of Calgary, Alberta, Canada, the balancing element is connected to the platform in a manner that permits angular displacement between the balancing element and the platform. This angular displacement is limited, and this limit is adjustable. The more angular displacement is permitted, the harder it is for a user to balance. To adjust the limit, the balancing element must be removed, and there are three discrete settings for the limit. To resume use of the device, the balancing element must be reattached.

One difficulty with this device is that the balancing element must be taken apart from the platform in order for the angular displacement limit to be adjusted. This causes adjustment of the wobbler to be time consuming and inefficient.

SUMMARY OF THE INVENTION

Therefore, in one aspect, what is desired is a wobbler device that can be easily used, with a simple procedure for adjusting the angular displacement limit. In another aspect, a new rocker device is desired. Accordingly, there is provided an exercise device for improving balance, the device comprising:

a platform configured to receive the body of a person;

a balancing element positioned on an underside of the platform, the balancing element being mounted to the platform so as to permit angular displacement of the balancing element relative to the platform;

an adjustable angular displacement limiter, coupled to the platform, for determining a limit of the angular displacement of the balancing element relative to the platform;

an adjustment access path to provide adjustment access to the limiter while the balancing element is operably mounted to the platform.

Preferably, the limiter is continuously adjustable. Preferably, the limiter is mounted on a threaded shaft extending from the underside. Preferably, the limit is adjusted by rotating the limiter to move the limiter along the shaft. Preferably, the balancing element includes a limiter-receiving cavity, and wherein the limiter is shaped to fit within said cavity such that the limit is lower when the limiter extends more deeply into the cavity and greater when the limiter extends less deeply into the cavity. Preferably, the limiter comprises a limiting element, and an adjuster, operatively connected to the limiting element, for adjusting the position of the limiting element. Preferably, the adjuster extends radially outward from the shaft to facilitate adjustment of the limiter. Preferably, the adjuster is generally disc-shaped and wherein the limiting element depends from the adjuster. Preferably, the limiting element has a substantially frusto-conical shape. Preferably, the cavity is shaped substantially as a parallelepiped. Preferably, the device includes as least two springs, and wherein the at least two springs are fixedly attached to the platform and to the balancing element to flexibly mount the balancing element to the platform. Preferably, the device includes four springs, wherein the four springs are fixedly attached to the platform and to the balancing element to flexibly mount the balancing element to the platform. Preferably, the access path comprises space adjacent the underside and adjacent the balancing element. Preferably, the access path comprises space between the balancing element and the underside. Preferably, the balancing element includes at least one depression formed therein, and wherein the access path comprises the depression.

In another aspect, there is provided a rocker device for improving balance, the rocker device comprising:

a central platform;

an elongate balancing body fixedly attached to a floor-facing side of the central platform, the balancing body having two end portions each extending outward from a corresponding side of the central platform, each end portion being configured to detachably attach to an extension platform to extend the central platform;

two extension platforms configured to detachably attach to the balancing body so as to permit a person to stand on the central and extension platforms and balance about the balancing body.

Preferably, the extension platforms each have at least one hook, and wherein each end portion has at least one hole configured to receive the at least one hook.

BRIEF DESCRIPTION OF THE DRAWINGS

Reference will now be made, by way of example only, to the drawings, which illustrate the referred embodiment of the invention, and in which.

DETAILED DESCRIPTION OF THE PREFERRED EMBODIMENTS

Figure 1:
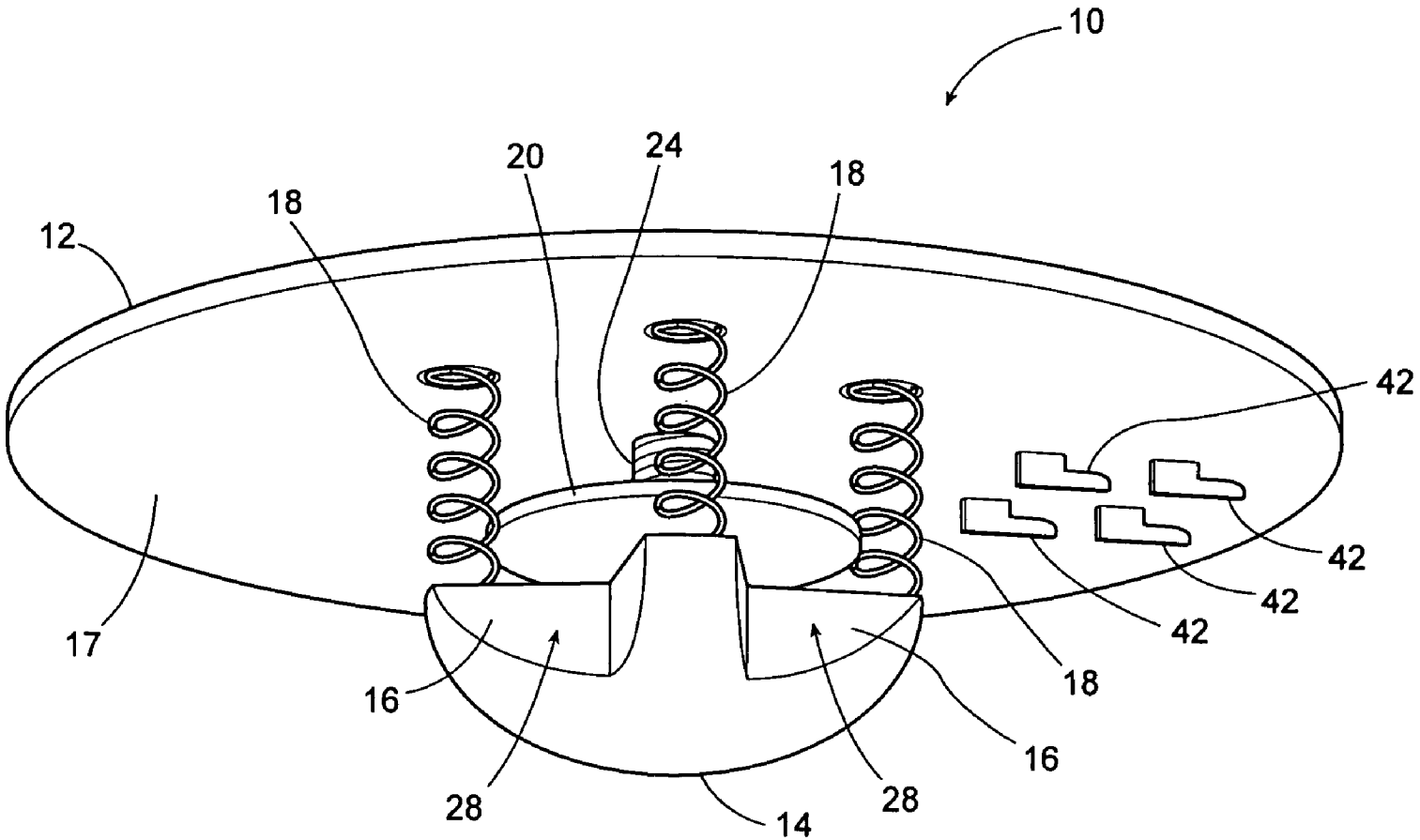
FIG. 1 is a bottom perspective view of the balancing device.
Figure 2:
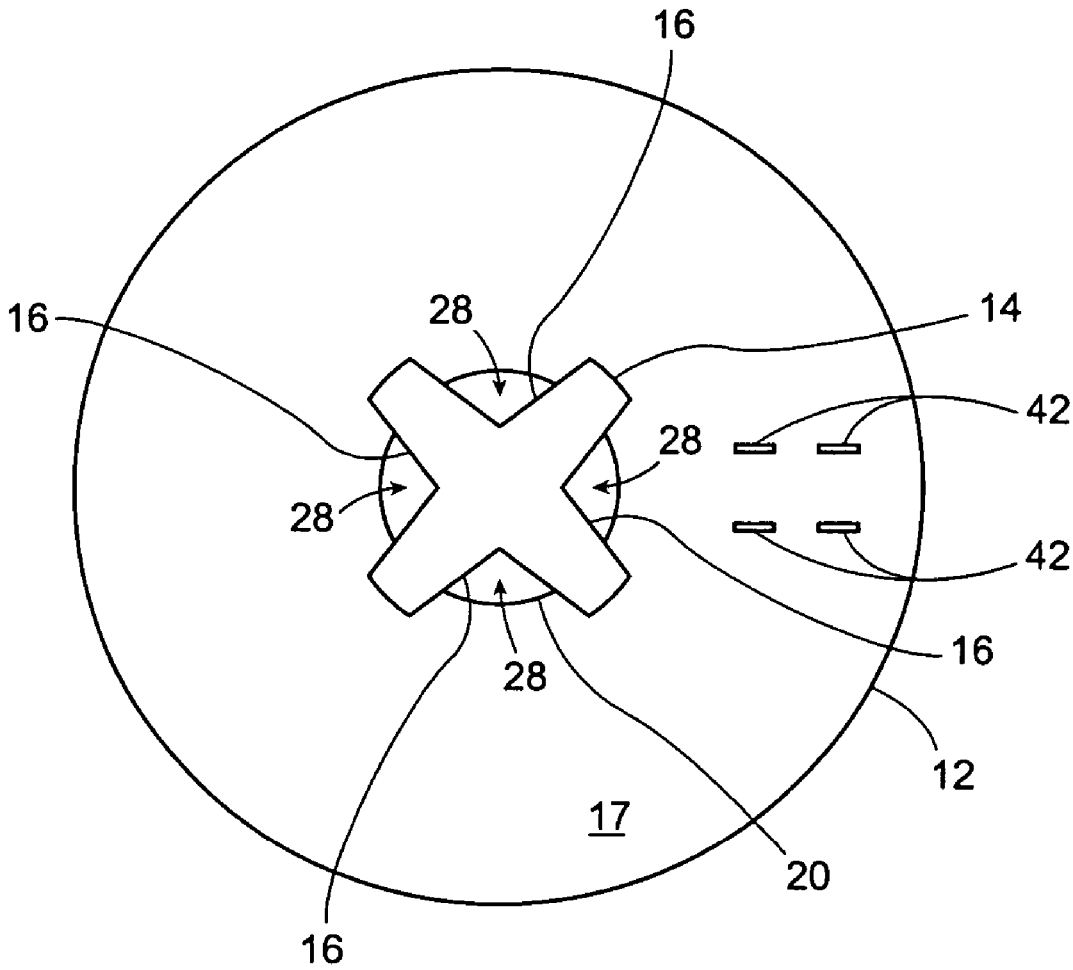
FIG. 2 is a bottom view of the balancing device.
Figure 3:
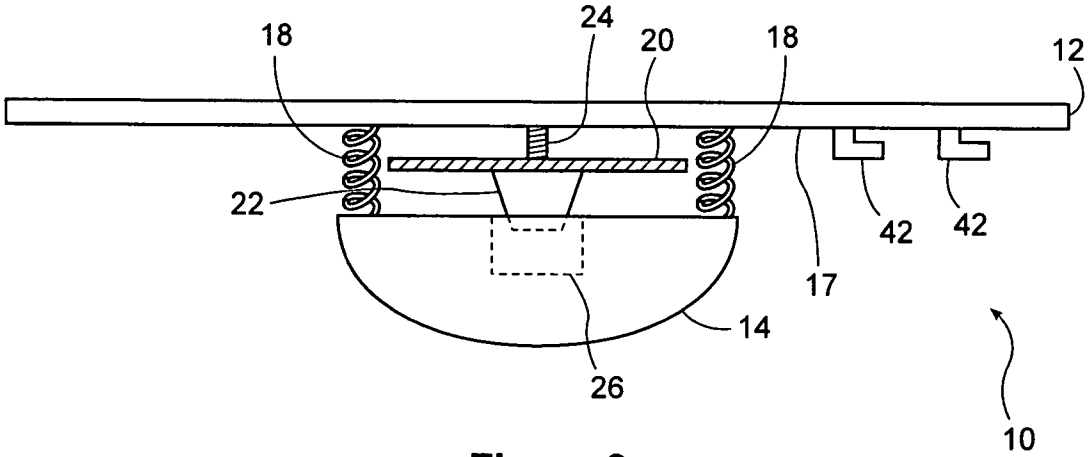
FIG. 3 is an elevation view of the balancing device with the angular displacement limit set to a high limit.

Referring now to FIGS. 1-5, an exercise device 10 for improving balance is shown. The device 10 includes a platform 12 configured to receive the body of a person. Preferably, the platform 12 comprises a flat element that is circular in plan view. Typically, a person's body is received by the platform 12 by the person standing on the platform 12. However, it will be appreciated that the platform 12 may take other forms besides the preferred form described above, and still be comprehended by the invention. For example, the platform 12 can have contours that define spaces for placement of the user's feet. Alternatively, the user may wish to use a device 10 by kneeling on the platform 12, and in such a case, the platform 12 may include contours 12 shaped to receive the user's knees. Other configurations are also comprehended. What is important is that the platform 12 be configured to receive the body of a person.

The device 10 further comprises a balancing element, preferably in the form of a generally semi-spherical element 14. The element 14 preferably includes at least one, and most preferably, four depressions 16 formed in the element 14.

The element 14 is preferably positioned on the underside 17 of the platform 12, and is operably mounted to the platform 12 so as to permit angular displacement of the element 14 relative to the platform 12. In other words, the element 14 is mounted so as to be able to rotate relative to the platform 12. It will be appreciated that the element 14 may be either directly or indirectly mounted to the platform 12. What is important is that the balancing element be operably mounted to the platform 12 so as to permit angular displacement of the balancing element relative to the platform 12.

Preferably, the device 10 includes at least one spring 18, preferably two springs 18, more preferably three, and most preferably, four springs 18. Preferably, the springs 18 are fixedly attached to the platform 12 and element 14, with the result that the element 14 is flexibly mounted to the platform 12. Because, in the preferred form of the device 10, springs 18 (which are flexible) are used to operably mount the element 14 to the platform 12, angular displacement of the element 14 relative to the platform 12 is permitted. It will be appreciated, however, that other methods of mounting the element 14 to the platform 12 are comprehended by the invention. What is important is that the element 14 be operably mounted to the platform 12 so as to permit angular displacement of the element 14 relative to the platform 12.

It can be appreciated how this preferred configuration permits angular displacement. Because the element 14 is mounted on four springs 18, the element 14 is capable of rotating so that one of the springs 18 is contracted, while the opposite spring 18 expands. In this way, the element 14 can be angularly displaced so that part of the element 14 moves toward the underside 17, while another part moves away from the underside 17, thus tilting the element 14 relative to the underside 17.

The device 10 further includes an adjustable angular displacement limiter positioned so as to determine a limit of the angular displacement of the element 14 relative to the platform 12. Preferably, the limiter comprises an adjuster 20 for adjusting the limit, and a limiting element 22, to which the adjuster 20 is operatively connected. The adjuster 20 preferably functions to adjust the limit by adjusting the position of the limiting element 22.

Preferably, a threaded shaft 24 is fixed to the platform 12 and extends outward from the underside 17. The limiter, preferably comprising the adjuster 20 and element 22, is preferably rotatably mounted on the shaft 24. When the adjuster 20 is rotated in one direction, the adjuster 20 and element 22 move upward along the shaft 24 toward the underside 17. When the adjuster 20 is rotated the other way, the adjuster 20 and element 22 move downward along the shaft 24, away from the underside 17. Most preferably, the element 22 depends from the adjuster 20, which adjuster is most preferably generally disc-shaped. Therefore, the generally disc-shaped adjuster 20, which is attached to the shaft 24 generally at the centre of the disc shape, extends radially outward in all directions from the shaft 24 to facilitate adjustment of the element 22.

It will be appreciated that the position of the element 22, and thus the limiter, is continuously adjustable. In the preferred form of the device 10, this continuous adjustment is achieved by rotating the adjuster 20 on the threaded shaft 24. In this way, with the range of positions of the limiter, the limiter is not confined to a finite number of discrete settings. Rather, the limiter, and thus the angular displacement, are continuously adjustable and have an infinite number of settings.

It will be appreciated that finite, discrete limit settings are less preferred, because the desired limit may not correspond to any possible limit setting. By contrast, precise setting of the limit is possible.

Preferably the element 22 is sized, shaped and positioned such that, when the angular displacement limit is reached, the element 22 bears on the balancing element 14 and keeps it from exceeding the angular displacement limit. Most preferably, the element 22 is a generally frusto-conical element extending from the adjuster 20 toward the element 14, and is positioned opposite a limiter-receiving cavity 26 in the element 14. The cavity 26 is sized, shaped and positioned such that the element 14 moves progressively further inside the cavity 26 as the element 14 moves along the shaft 24 away from the underside 17 (see FIG. 4), and is progressively withdrawn from the cavity 26 as the element 14 moves along the shaft 24 toward the underside 17 (see FIG. 3).

Figure 4:
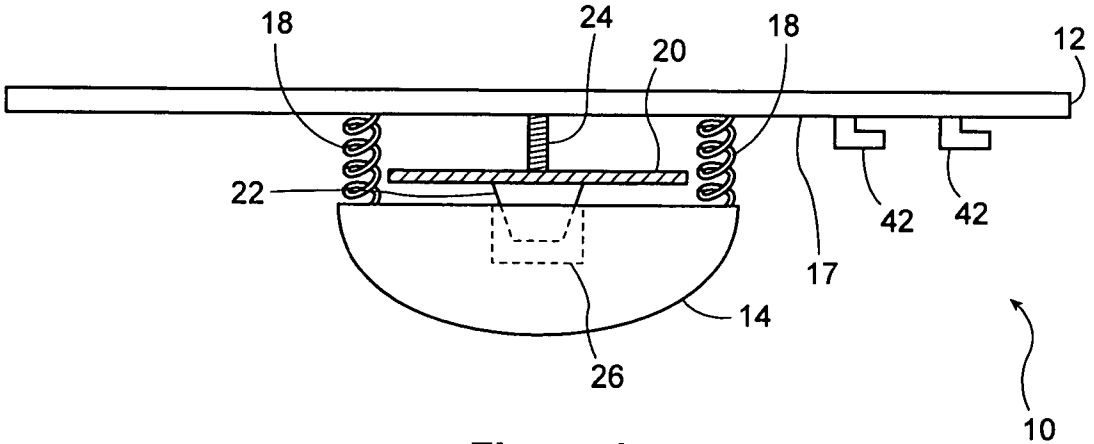
FIG. 4 is an elevation view of the balancing device with the angular displacement limit set to a low limit.
Figure 5:
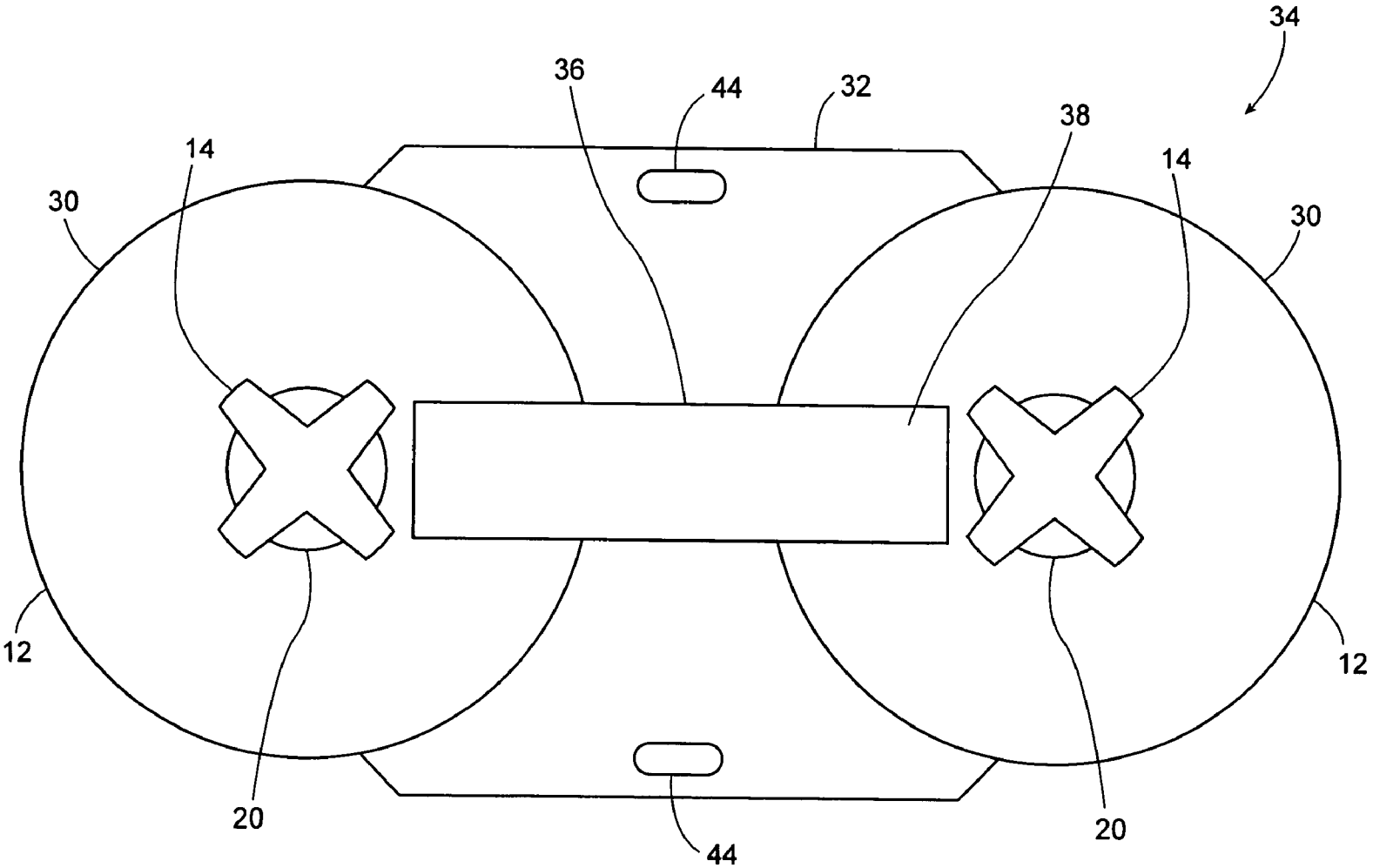
FIG. 5 is a bottom view of the rocker device.
Figure 6:
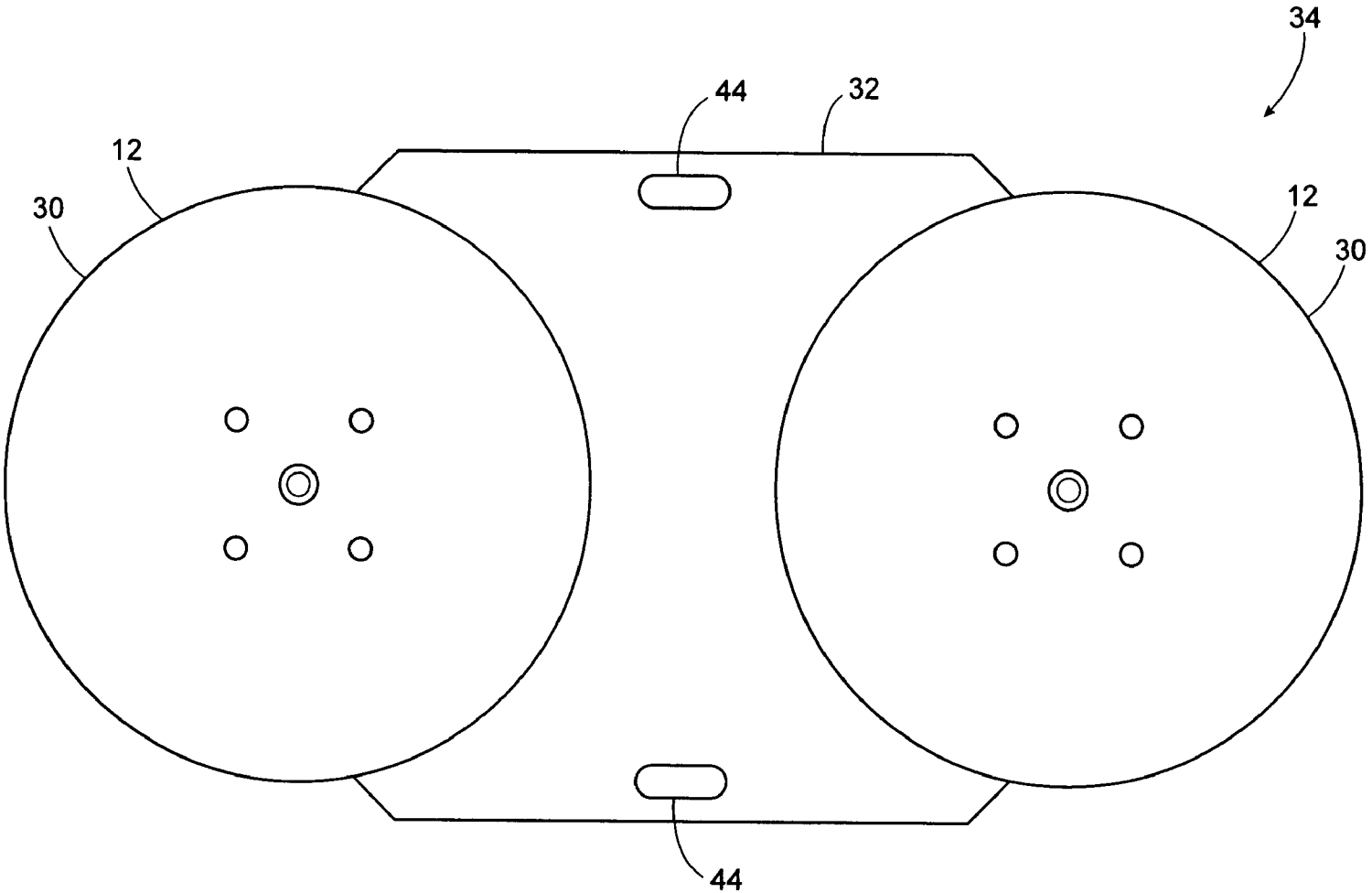
FIG. 6 is a top view of the rocker device.
Figure 7:
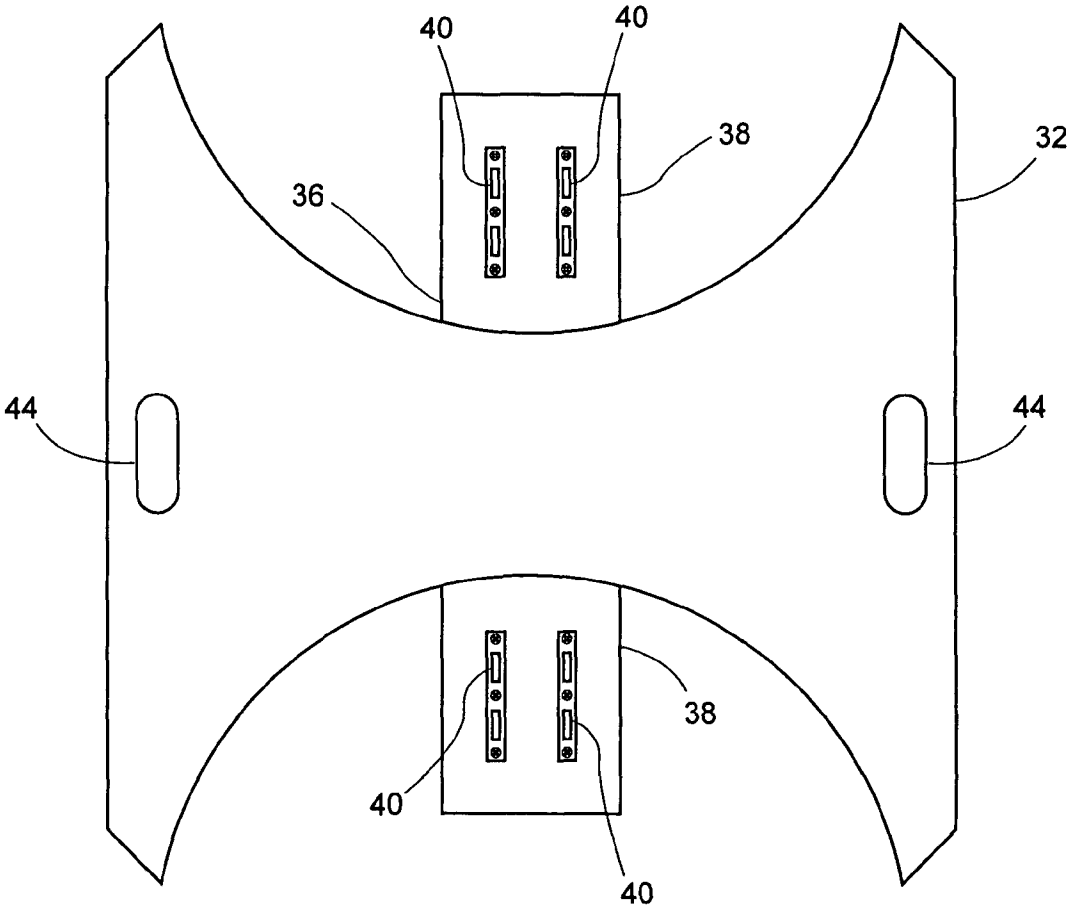
FIG. 7 is a top view of the central platform.
Figure 8:
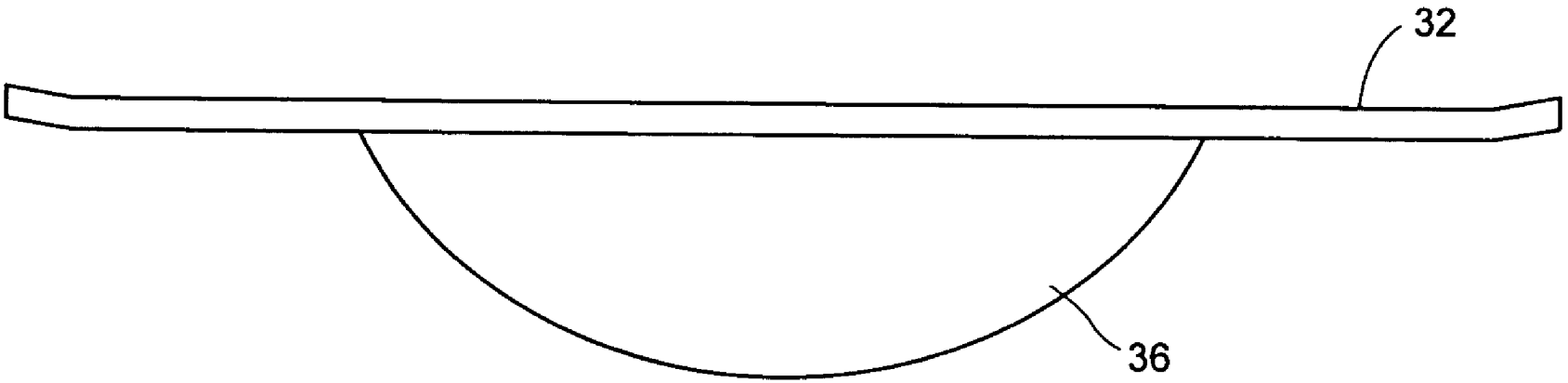
FIG. 8 is a side view of the central platform and elongate balancing element.

The cavity 26 and element 22 are sized and shaped such that, the deeper inside the cavity 26 the element 22 is positioned, the lower the possible angular displacement of the element 14 before the element 22 bears on the element 14 and prevents further angular displacement (see FIG. 4). In other words, the angular displacement limit is progressively smaller as the element 22 moves deeper into the cavity 26, and is progressively larger as the element 22 moves progressively further out of the cavity 26 (see FIG. 3). Thus, the angular displacement limit is adjusted by adjusting the position of the element 22.

Most preferably, the element 22 has a frusto-conical shape, such that the radius of the element 22 is lower the further along the element 22 and away from the underside 17 one travels. Most preferably, the cavity 26 has either a frusto-conical shape, or the shape of a parallelepiped. In either case, the cavity 26 is shaped so that, when the element 22 is further inside the cavity 26, there is less room for angular displacement of the element 14 before the element 22 bears on a wall or edge of the cavity 26, thus preventing further angular displacement. When the element 22 is less deeply inside the cavity 26, more angular displacement is possible before the element 22 bears on the element 14 to prevent further angular displacement.

It will be appreciated that other forms of angular displacement limiter are comprehended by the invention. For example, the element 22 (and the cavity 26) could have different shapes. Alternatively, the angular displacement limiter could take a completely different form not involving an element 22 entering a cavity 26 in the element 14. What is important is that the angular displacement limiter functions to determine a limit of the angular displacement relative to the platform 12 of the balancing element.

Preferably, the device 10 includes an adjustment access path 28 to provide adjustment access to the angular displacement limiter while the balancing element 14 is operably mounted to the platform 12. The adjustment access path 28 provides adjustment access to the limiter while the element 14 is operably mounted to the underside 17 of the platform 12. In the preferred form of the device 10 herein described, the path 28 comprises space adjacent the underside 17 and the element 14, and between the underside 17 and element 14. In addition, most preferably, the path 28 comprises the space adjacent the one or more depressions 16 in the element 14. It will be appreciated that, in this preferred form, the depressions 16 provide space for the path 28 to permit the adjuster 20 to be accessed for limiter adjustment (see FIGS. 1 and 2). At the same time, the adjuster 20 extends far enough outward from the shaft 24 to allow the adjuster 20 to be accessed by the hand of a user.

It will be appreciated that the path 28 and adjuster 20 can take different forms than the preferred forms described above, and still be comprehended by the invention. For example, though less preferred, the adjuster could take the form of an element rotatable by a screw driver, and the adjustment access path can take the form of a narrow passage through the element 14 providing adjustment access to the adjuster while the element 14 remains mounted to the platform 12. Other configurations are also possible. What is important is that the adjustment access path provides adjustment access to the limiter while the balancing element is operably mounted to the platform.

It can now be appreciated how and when the device 10 would preferably be used. There are a number of reasons why the device 10 would be useful to a user. For example, a user may be recovering from knee, ankle, or hip surgery, and could use the device 10 to strengthen and rehabilitate related muscles. Alternatively, a user may wish to improve his balance in order to improve his play in one or more sports.

To use the device 10, a user will preferably adjust the angular displacement limit to the estimated desired amount. The user would then place the device 10 on the floor, with the element 14 against the floor. The user would place his feet on the platform 12 and balance on the element 14 by attempting to keep the platform 12 from touching the floor. The amount that the device 10 is used, and the specific method of its use, will depend on the results that are desired by the user, and the advice of any medical professionals or coaches.

If it is desired to adjust or re-adjust the angular displacement limit before or during use of the device 10, the user can simply follow the adjustment access path 28 to the adjuster 20, and move the adjuster 20 to adjust and set the angular displacement limit. In this preferred form, there is no need to waste time by removing the element 14 to adjust the angular displacement limit. In addition, in the preferred form of the device 10, the angular displacement limit is continuously adjustable. This is in contrast to less preferred devices, in which the angular displacement limit may only be set at a limited number of discrete settings.

Referring now to FIGS. 1 and 5-8, the devices 10 can be used as extension platforms 30, in combination with a central platform 32, for creating a rocker device 34. In this rocker device, the central platform 32 has, fixedly attached to a floor-facing side of the platform 32, a balancing body in the form of an elongate rocker 36 having two end portions 38 each extending outward from a corresponding side of the central platform 32. Each end portion 38 is configured, to detachably attach to an extension platform 30 to extend the central platform 32. To this end, each end portion 38 preferably has hook receivers 40 which are configured to receive locking hooks 42 on the underside 17 of the extension platforms 30 (see FIG. 1). Thus, the platforms 30 are configured to detachably attach to the rocker 36 so as to permit a person to stand on the central platform 32 and extension platforms 30 and balance about the rocker 36. The platform 32 includes handles 44 for easy carrying.

It will thus be appreciated that the rocker 36 and balancing elements 14 of the two extension platforms 30 act, in combination, as an elongate rocking element having an axis about which a user performs balancing exercises. Thus, when it is desired to use a rocker device, the two devices 10 can be used in combination with the central platform 32 to make a rocker device. When it is desired to use a wobbler for different types of balancing exercises, a single device 10 can be used by a user.

Alternatively, it may be desirable for a user to use two wobbler devices 10 independently, with one of the user's feet on each device 10. Such exercises would be used by advanced users who are seeking to improve the balance on each side of their bodies, or perhaps to strengthen each of their ankles.

While the foregoing embodiments of the present invention have been set forth in considerable detail for the purposes of making a complete disclosure of the invention, it will be apparent for those skilled in the art that various modifications can be made to the device without departing from the broad scope of the invention as defined in the attached claims. Some of these variations are discussed above and others will be apparent to those-skilled in the art. For example, different shapes and forms of the balancing element are possible within the scope of the attached claims. What is important is to provide a device 10 for improving balance wherein the limit of angular displacement can be adjusted without removing the balancing element.

The embodiments of the invention in which an exclusive property or privilege is claimed are defined as follows:

1. An exercise device for improving balance, the device comprising:

a platform configured to receive the body of a person;

a balancing element comprising a curved floor contacting portion positioned at an underside of the platform and configured to contact a floor when the device is in use, wherein the balancing element causes the platform to pivot relative to the floor to bear on the floor unless the person balances on the platform to prevent the platform from bearing on the floor, the balancing element being mounted to the underside of the platform, the platform being pivotable relative to the balancing element so as to permit angular displacement of the platform with respect to the balancing element while the person balances on the platform;

an adjustable angular displacement limiter, coupled to the platform and operatively associated with the balancing element, such that the limiter is adjustably engageable and disengageable with the balancing element, wherein the limiter limits the angular displacement of the platform relative to the balancing element when engaged with the balancing element, and wherein the platform is freely pivotable with respect to the balancing element when the limiter is disengaged from the balancing element; and an adjustment access path to provide adjustment access to the limiter while the balancing element is operably mounted to the platform;

whereby the device is adapted for a person to balance movement of the platform relative to the floor and simultaneous movement of the platform relative to the balancing element.

2. An exercise device as claimed in claim 1, wherein the limiter is continuously adjustable.

3. An exercise device as claimed in claim 2, wherein the limiter is mounted on a threaded shaft extending from the underside.

4. An exercise device as claimed in claim 3, wherein the limit is adjusted by rotating the limiter to move the limiter along the shaft.

5. An exercise device as claimed in claim 3, wherein the limiter comprises a limiting element, and an adjuster, operatively connected to the limiting element, for adjusting the position of the limiting element.

6. An exercise device as claimed in claim 5, wherein the adjuster extends radially outward from the shaft to facilitate adjustment of the limiter.

7. An exercise device as claimed in claim 6, wherein the adjuster is generally disc-shaped and wherein the limiting element depends from the adjuster.

8. An exercise device as claimed in claim 7, wherein the limiting element has a substantially frusto-conical shape.

9. An exercise device as claimed in claim 1, wherein the balancing element includes a limiter-receiving cavity and wherein the limiter is shaped to fit within said cavity such that the limit is lower when the limiter extends more deeply into the cavity end greater when the limiter extends less deeply into the cavity.

10. An exercise device as claimed in claim 9, wherein the device includes as least two springs, and wherein the at least two springs are fixedly attached to the platform and to the balancing element to flexibly mount the balancing element to the platform.

11. An exercise device as claimed in claim 1, wherein the limiter comprises a limiting element, and an adjuster, operatively connected to the limiting element, for adjusting the position of the limiting element.

12. An exercise device as claimed in claim 11, wherein the cavity is shaped substantially as a parallelepiped.

13. An exercise device as claimed in claim 1, wherein the device includes as least two springs, and wherein the at least two springs are fixedly attached to the platform and to the balancing element to flexibly mount the balancing element to the platform.

14. An exercise device as claimed in claim 13, wherein the device includes four springs, wherein the four springs are fixedly attached to the platform and to the balancing element to flexibly mount the balancing element to the platform.

15. An exercise device as claimed in claim 1, wherein the access path comprises space adjacent the underside and adjacent the balancing element.

16. An exercise device as claimed in claim 15, wherein the access path comprises space between the balancing element and the underside.

17. An exercise device as claimed in claim 1, wherein the balancing element includes at least one depression formed therein, and wherein the access path comprises the depression.

18. An exercise device as claimed in claim 1, wherein the balancing element is mounted to the platform via at least one spring extending from the underside of the platform to the balancing element.

19. An exercise device for improving balance, the device comprising:

a platform configured to receive the body of a person;

a balancing element positioned on an underside of the platform and configured to contact a floor when the device is in use, the platform and balancing element being sized, shaped, and/or positioned such that the balancing element causes the platform to pivot relative to the floor to bear on the floor unless the person balances on the platform to prevent the platform from bearing on the floor, the balancing element being mounted to the underside of the platform so that the platform is freely pivotable about the balancing element so as to permit free angular displacement of the platform with respect to the balancing element while the person balances on the platform;

an adjustable angular displacement limiter, coupled to the underside of the platform and operatively associated with the balancing element, such that the limiter is adjustably engageable and disengageable with the balancing element, wherein the limiter limits the free angular displacement of the platform relative to the balancing element, the limiter comprising a limiting element and the balancing element comprising a limiter-engaging surface, wherein the limiting element is movably coupled to the underside of the platform so as to have an adjustable position between the platform and the balancing element and is shaped to engage the limiter engaging surface such that the angular displacement of the platform relative to the balancing element is limited when the limiting element engages the limiter-engaging surface, and wherein the platform is freely pivotable relative to the balancing element when the limiting element is disengaged with the limiter-engaging surface; and an adjustment access path to provide adjustment access to the limiter while the balancing element is operably mounted to the platform;

whereby the device is adapted for a person to balance movement of the platform relative to the floor and simultaneous movement of the platform relative to the balancing element.

20. The exercise device as claimed in claim 19, wherein the limiter-engaging surface comprises a limiter-receiving cavity, wherein the limiting element is shaped to fit within the cavity such that the angular displacement of the platform relative to the balancing element is lower when the limiting element extends more deeply into the cavity and greater when the limiting element extends less deeply into the cavity.

* * * * *